US005612281A

United States Patent [19]

Kobayashi et al.

[11] Patent Number: 5,612,281

[45] Date of Patent: Mar. 18, 1997

[54] RECORDING SHEET

[75] Inventors: Takashi Kobayashi; Yoshio Tani, both of Shizuoka, Japan

[73] Assignee: Fuji Photo Film Co., Ltd., Kanagawa, Japan

[21] Appl. No.: 417,864

[22] Filed: Apr. 5, 1995

[30] Foreign Application Priority Data

Apr. 5, 1994 [JP] Japan ..... 6-090557

[51] Int. Cl.[6] ..... B41M 5/00; B41M 5/035; B41M 5/26; B41M 5/38

[52] U.S. Cl. ..... 503/227; 427/152; 428/195; 428/206; 428/304.4; 428/331; 428/520; 428/913; 428/914

[58] Field of Search ..... 428/195, 206, 428/318.4, 331, 500, 520, 913, 914, 304.4; 503/227; 427/152; 8/471

[56] References Cited

U.S. PATENT DOCUMENTS 5,002,825 3/1991 Mimura et al. ..... 428/315.5
5,411,787 5/1995 Kulkarni et al. ..... 428/195

*Primary Examiner*—Bruce H. Hess
*Attorney, Agent, or Firm*—Sixbey, Friedman, Leedom & Ferguson, P.C.; Gerald J. Ferguson, Jr.

[57] ABSTRACT

A recording sheet for ink-jet recording, thermal transfer recording or electrographic recording comprises a transparent support and a transparent colorant-receptive layer, in which the colorant-receptive layer has a void volume of 50–80%, in which the network structure is formed of silica fine particles having a mean primary particle diameter of 10 nm or less and a water-soluble resin, and the weight ratio of silica fine particles/the water-soluble resin is in the range of 1.5/1 to 10/1.

6 Claims, 2 Drawing Sheets

RECORDING SHEET

FIELD OF THE INVENTION

The present invention relates to a recording sheet for recording information thereon using a colorant, and more particularly to a recording sheet for forming a transparency (an image fixed on a transparent base adaptable for viewing by transmitted light) by ink-jet recording, thermal transfer recording or electrophotographic recording.

BACKGROUND OF THE INVENTION

As information industry rapidly progresses recently, a variety of information processing systems, and recording methods or apparatuses suitable for those information processing systems have been developed and employed. In such recording methods, ink recording using a jet for emitting ink or a plotter and thermal transfer recording using a melt type colorant or a sublimation type colorant employs apparatuses which are lightweight, compact-sized and noiseless and further excellent in operating properties and maintainability. Moreover, the apparatuses used in those recording methods can be easily modified to provide color recording, and hence those recording methods have been widely used in recent years. Also in the conventional electrophotographic recording method, full color printers and copying machines showing high resolving power have been developed and commercialized, while the color recording has progressed.

Recording methods for the ink-jet recording can be roughly classified into three methods: a method of using an aqueous dye solution of a water-soluble dye (aqueous ink), a method of using a dye solution obtained by dissolving an oil-soluble dye in an organic solvent (oily ink) and a method of using a molten low-temperature-melting solid wax containing a dye (wax ink). The method of using the aqueous ink is mainly adopted. In any of those methods, an image is formed by emitting the ink in the form of fine droplets onto a recording sheet.

The thermal transfer recording can be roughly classified into two methods: a first method of imagewise applying heat to an ink-sheet having a hot-melt ink coated on a support from the support side to melt the ink according to the pattern, and transferring the thus melted ink to a recording sheet to obtain an ink image (melt type thermal transfer method); and a second method of imagewise applying heat to an ink-sheet comprising a Support and a layer of a high-temperature-melting resin and a sublimation dye from the support side in the same manner as described in the first method to sublimate the sublimation dye according to the pattern, and transferring the dye thus sublimated to a recording sheet to obtain an image (sublimation type thermal transfer method).

In the electrophotographic recording, mainly employed is a method in which an light pattern is applied to an electrostatically charged photoconductive layer to form an electrostatic latent image, the latent image is developed with toner, the toner image is transferred to a recording sheet, and finally the toner image is melted and fixed on the recording sheet under heating. Such recording sheet is usually required to have excellent adhesion to toner and resistance to embossing (formation of uneven surface of the recording sheet produced when an image was copied on the recording sheet by the electrophotographic copying machine).

For OHP films which have been widely used for presentation in place of slides, films for back light display which have been widely used in place of printed posters or display boards, and intermediates (namely, prints which are used as a master for further production), the recording sheet is required to be transparent. Such transparent sheet usually comprises a transparent film and a colorant-receptive (absorbing) layer provided thereon. Also in the transparent sheet, an image is formed thereon as described above, so as to prepare an sheet having a transparency (an image fixed on a clear base especially adaptable for viewing by transmitted light).

An image which has been formed on the transparent film by these recording methods, is required to show not only excellent hue, saturation and lightness but also good adhesion between a colorant and the surface of the recording sheet. Moreover, the ink-jet recording needs the transparent film to rapidly absorb a liquid ink and not to allow bleeding or blooming of ink or forming of puddle of ink on the film, from the viewpoint of obtaining a clear image.

In order to solve those problems, various proposals have been made so far. As for the transparent sheet forming transparency, the proposals are as follows:

Japanese Patent Provisional Publications No. 57(1982)-14091 and No. 61(1986)-19389 disclose a recording sheet comprising a support and a transparent layer composed of colloidal silica and water-soluble resin. The transparent layer has a low void volume because the colloidal silica has a large particle size and the amount of water-soluble resin is large, compared with that of colloidal silica. Therefore, the recording sheet does not give a satisfactory ink absorption speed.

Further, a recording sheet having a colorant-receptive layer having fine pores which is formed of pseudo-boehmite fine particles is described in Japanese Patent Provisional Publications No. 2(1990)-276670 and No. 3(1991)-281383. According to the studies by the inventor, however, it has been confirmed that sufficient transparency cannot be obtained by this recording sheet because of its high refractive index of about 1.65, though the ink absorption properties are satisfactorily improved.

Japanese Patent Publication No. 61(1986)-53958 discloses a recording sheet comprising a support and a transparent layer composed of synthetic silica, a fine inorganic particle of refractive index of 1.44–1.55 and water-soluble resin. The synthetic silica usually has a mean primary particle diameter of more than 10 nm, and further contains secondary particles having size of several hundreds nm. Therefore, the secondary particles are apt to scatter light applied thereto, whereby the recording sheet containing the particles does not show a satisfactory light transmittance. Further, the transparent layer has relatively large pores due to the large secondary particles and hence does not satisfactorily prevent occurrence of bleeding or blooming of ink.

SUMMARY OF THE INVENTION

It is, therefore, an object of the present invention to provide a recording sheet having a colorant-receptive layer by the use of which a transparency (transmission image) can be obtained by ink-jet recording, thermal transfer recording or electrophotographic recording.

It is another object of the invention to provide a recording sheet which has high transmittance and is capable of forming thereon an image of excellent hue, saturation and lightness.

It is a further object of the invention to provide a recording sheet of high transmittance suitable for ink-jet recording wherein a clear image almost free from occurrence of bleeding or blooming of ink or puddle of ink can be obtained.

It is a still further object of the invention to provide a recording sheet of high transmittance to which a colorant is firmly fixed in the case of thermal transfer recording or which is excellent in adhesion of toner and resistance to embossing in the case of electrophotographic recording.

The objects of the invention can be achieved by a recording sheet comprising a transparent support and a transparent colorant-receptive layer provided thereon, in which the colorant-receptive layer has a three-dimensional network structure having void volume (void ratio) of 50 to 80%, the three-dimensional network structure being formed from silica fine particles having a mean primary particle diameter of not more than 10 nm and a water-soluble resin wherein a weight ratio between the silica fine particles and the water-soluble resin is in the range of 1.5:1 to 10:1.

The void volume means that the ratio of the volume of void space to the volume of solid substance (i.e., colorant-receptive layer in the invention) in any material consisting of void space and solid space.

Preferred embodiments of the recording sheet of the invention are described below.

(1) The recording sheet defined above, wherein the three-dimensional structure has pores of a mean diameter (mean pore diameter) of 5 to 30 nm.

(2) The recording sheet defined above, wherein the three-dimensional structure has a volume of pores in the range of 0.5 to 0.9 ml/g.

(3) The recording sheet defined above, wherein the fine silica particles are fine particles of silicic anhydride (anhydrous silica).

(4) The recording sheet defined above, wherein the silica fine particles have 2 to 3 silanol groups per 1 $nm^2$ on the particle surface.

(5) The recording sheet defined above, wherein the three-dimensional network structure is composed of chains formed by linkage of secondary particles having diameters of 10 to 100 nm which are aggregated products of the silica fine particles.

(6) The recording sheet defined above, wherein the water-soluble resin is polyvinyl alcohol.

(7) The recording sheet defined above, wherein the colorant-receptive layer has a BET specific surface area of 100 to 250 $m^2/g$.

(8) The recording sheet as defined above, wherein the colorant-receptive layer has a light transmittance of not less than 70%.

(9) The recording sheet defined above, wherein a layer comprising a silan coupling agent having a quaternary ammonium salt group is provided on the colorant-receptive layer.

(10) The recording sheet defined above, wherein an anti-reflection layer having a refractive index of not more than 1.45 is provided on the transparent support on the side having no colorant-receptive layer.

(11) The recording sheet defined above, wherein a resin layer having anti-reflection properties is provided on the transparent support on the side having no colorant-receptive layer, the resin layer having a refractive index which satisfies both conditions of more than 1.45 and not more than a refractive index of the transparent support.

The recording sheet of the invention can be advantageously employed in an image forming process wherein an image is formed on the colorant-receptive layer of the recording sheet by an ink jet recording. The recording sheet used for ink-jet recording preferably has the colorant-receptive layer having a thickness of 10 to 50 μm.

Further, the recording sheet can be advantageously employed in an image forming process wherein an image is formed on the colorant-receptive layer of the recording sheet by electrophotographic recording. The recording sheet used for the electrophotographic recording preferably has the colorant-receptive layer having a thickness of 0.1 to 10 μm.

Furthermore, the recording sheet can be advantageously employed in an image forming process wherein an image is formed on the colorant-receptive layer of the recording sheet by thermal recording. The recording sheet used for thermal recording preferably has the colorant-receptive layer having a thickness of 0.1 to 10 μm.

The recording sheet of the invention rapidly absorbs a liquid ink to form thereon a precise visible image free from occurrence of bleeding or blooming of ink or puddle of ink, in the ink-jet recording. In the thermal transfer recording, a colorant is firmly fixed to the surface of the transparent recording sheet. In the electrophotographic recording, the transparent recording sheet is excellent in toner adhesion and resistance to embossing.

As described above, the recording sheet of the invention comprises a transparent support and a colorant-receptive layer provided thereon. The colorant-receptive layer has a three-dimensional network structure (having extremely fine pores) which consists of secondary particles of ultra-fine particles composed of specific silica, the specific silica generally having a refractive index near to 1.5 (at this refractive index, high transmittance is easily obtainable) and extremely small particle diameter and showing a low degree of light scattering.

Accordingly, the colorant-receptive layer is a layer of the three-dimensional structure having extremely fine pores and has a high void volume. In more detail, extremely fine pores are formed within the three-dimensional network structure constructed by linkage of aggregated silica particles having a refractive index near to 1.5, and hence the colorant-receptive layer is almost free from light scattering and shows high transmission. Further, because of its high void volume, the colorant-receptive layer is improved in the ink absorption properties and the prevention of occurrence of bleeding or blooming of ink, and moreover, the layer is enhanced in the adhesion of a colorant or a toner in the thermal transfer recording or the electrophotographic recording.

For the reasons as stated above, the recording sheet of the invention can be employed as a transparent recording sheet which is suitably used for various recording methods.

DETAILED DESCRIPTION OF THE INVENTION

The present inventors have made various studies to obtain a recording sheet particularly having excellent ink absorption properties (by increased void volume) and high transmission, and they have found that such desired recording sheet can be obtained by providing on a transparent support a colorant-receptive which is formed by highly dispersing specific silica, namely, ultrafine particles of silica (usually having a refractive index of about 1.5) having extremely small diameters, in water to prepare a silica dispersion, and adding a solution containing a small amount of a binder to the silica dispersion (for coating a surface of the aggregated silica particles) to prepare a coating solution, followed by coating the coating solution on the support and drying. Such colorant-receptive layer has three-dimensional network structure formed of linkage (flocculation) of aggregated ultrafine silica particles, and therefore the layer has high void volume and high transmission.

Thus, the recording sheet of the invention has a basic structure comprising a transparent support and a transparent, colorant-receptive layer provided on the support. The colorant-receptive layer in the recording sheet of the present invention is a layer of three-dimensional network structure having void volume of 50 to 80%. The three-dimensional network structure can be formed by the use of fine silica particles having a mean primary particle diameter of not more than 10 nm and a water-soluble resin in a weight ratio of 1.5:1 to 10:1 (silica fine particles: water-soluble resin).

Figure 1:
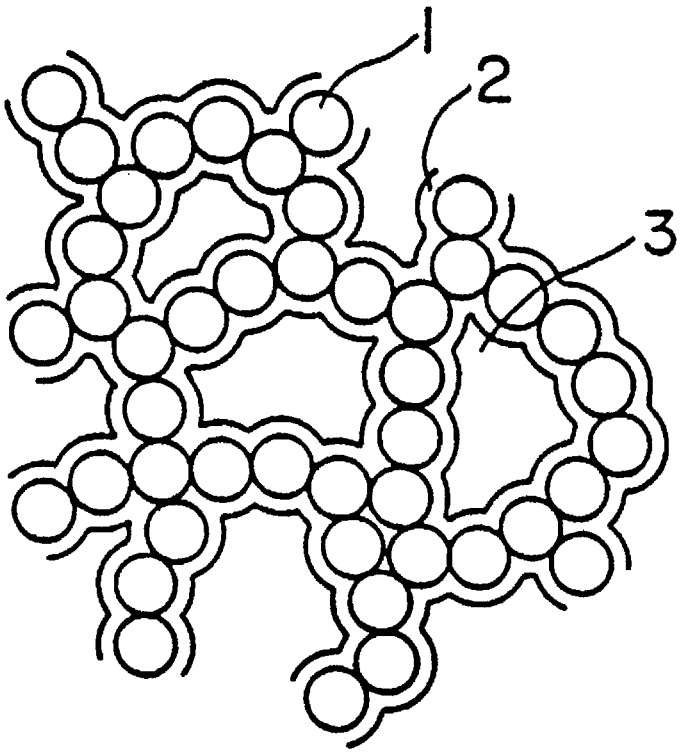
FIG. 1 is a schematic view illustrating an example of the three-dimensional network structure constituting the colorant-receptive layer of the invention.
Figure 2:
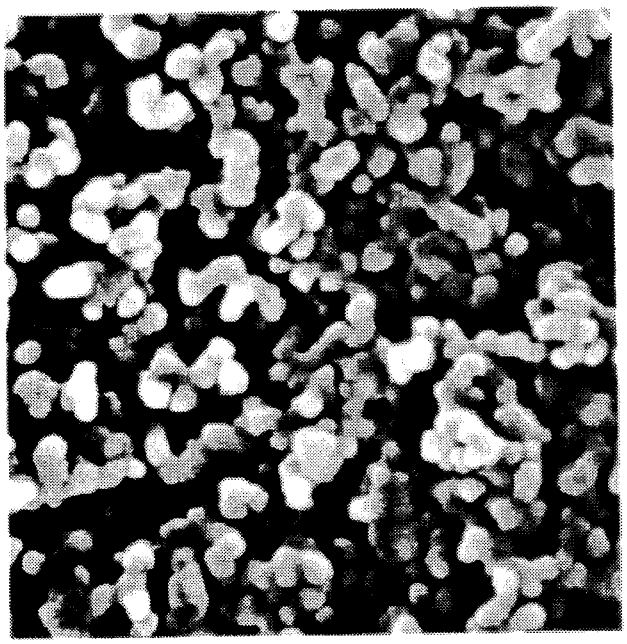
FIG. 2 is a photograph showing a scanning type electron photomicrograph of an example of a three-dimensional network structure which is present in the surface of the colorant-receptive layer according to the invention.
Figure 3:
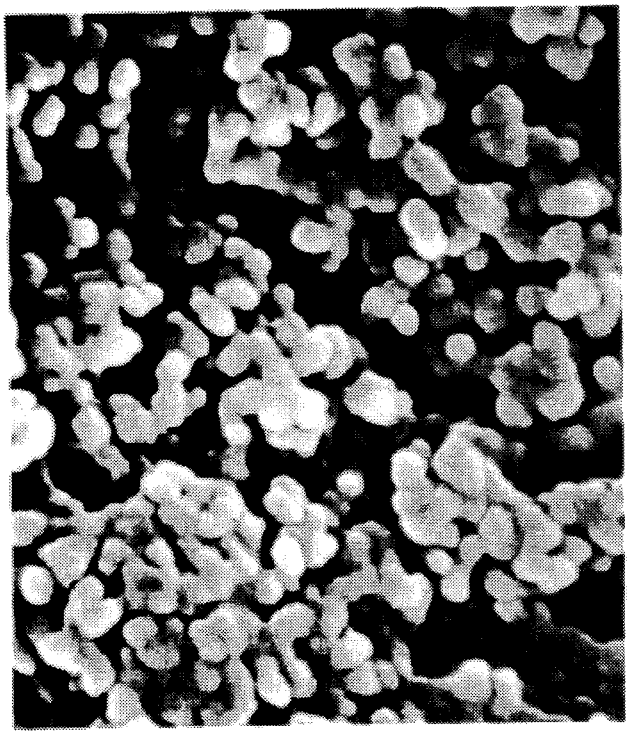
FIG. 3 is a photograph showing a scanning type electron photomicrograph of an example of a three-dimensional network structure which is present in the section of the colorant-receptive layer according to the invention.

FIG. 1 is a schematic view illustrating the colorant-receptive layer in the invention which is composed of the three-dimensional network structure formed of linkage (that is, flocculation) of aggregated ultrafine silica particles and water-soluble resin coated thereon. FIG. 2 shows a scanning type electron photomicrograph of the surface of the colorant-receptive layer in the invention. FIG. 3 shows a scanning type electron photomicrograph of the section of the colorant-receptive layer.

In FIG. 1, secondary particles 1 (i.e., aggregated products of silica fine particles) coated with a water-soluble resin 2 are linked (or flocculated) to each other to form a three-dimensional network structure, with forming pores 3 which form the void.

FIG. 2 and FIG. 3 show-electron photomicrographs of the surface and the section of the colorant-receptive layer, taken by a scanning type electron microscope at 100,000×magnification. From FIGS. 2 and 3, it can be seen that the three-dimensional network structure nearly corresponding to the schematic view of FIG. 1 is present both on the surface of the colorant-receptive layer and inside thereof.

The silica fine particles forming the secondary particles 1 have a mean primary particle diameter of not more than 10 nm (preferably 3 to 10 nm). They generally have a refractive index of 1.45. The silica particles are dispersed in the weight ratio described above using the water-soluble resin, whereby a three-dimensional network structure having the aggregated fine silica particles (secondary silica particles) as chain units is formed, and a void consisting of fine pores are formed in this network. Thus, a porous film structure having an extremely high void volume and showing highlight transmission properties is obtained.

As the particle diameter becomes small, the surface area per weight (specific surface area) generally becomes large and therefore opportunities producing interaction between the particles increases. The interaction is caused by the surface properties (e.g., electric properties on the surface or hydrogen bonding). In a dispersion (sol) where the ultrafine particles are highly dispersed and when the particles collide with each other in the dispersion, probability of adhesion of the particles is increased. The increase of adhesion of the particles forms the specific aggregation (consisting of aggregated fine silica particles) in which contact points between the particles are reduced. The aggregated products are linked (flocculated) to each other to form a three-dimensional network. Thus, a wet gel is produced. When the wet gel is dried, solvent (i.e., water) in the dispersion are evaporated to form fine pores in the three-dimensional network structure, so as to produce a porous xerogel.

In a wide sense, this process belongs to a sol-gel process, and hence the colorant-receptive layer in the invention is formed by utilizing sol-gel process. Formation of the fine pores in the three-dimensional network structure increasingly takes place with reducing the particles. Hence, a transparent porous film which is almost free from light scattering and high void volume can be formed especially by employing silica fine particles having a mean primary particle diameter of not more than 10 nm (preferably 3 to 10 nm, and more preferably 3 to 9 nm) and a water-soluble resin in combination in the above-mentioned weight ratio therebetween.

The silica particles easily adhere to each other by the silanol groups on the particle surface through hydrogen bonding, so that a structure having high void volume (void ratio) can be obtained in the case where the mean primary particle diameter is not more than 10 nm, as described above.

The processes for preparing silica particles are broadly classified into a wet process and a dry process. In the wet process, mainly adopted is a process in which a silicic salt is subjected to acid decomposition to produce active silica, and the active silica is properly polymerized and precipitated by aggregation to obtain hydrous silica. In the dry process, mainly adopted are a flame hydrolysis process in which silicon halide is hydrolyzed in a high-temperature gas phase to obtain silica containing no water, and an arc process in which siliceous sand and coke are heated, reduced and vaporized by means of arc in an electric furnace, followed by oxidizing with air, to obtain anhydrous silica. The hydrous silica and the anhydrous silica are different from each other in density of the silanol groups on the surface, presence or absence of a void, etc., and shows different characteristics. Anhydrous silica (silicic anhydride) is preferred in the invention because it easily forms a three-dimensional structure having particularly high void volume. Although the reason is not apparent, it is presumed that the hydrous silica has a high density of the silanol groups present on the particle surface (i.e., 5 to 8 silanol groups/$nm^2$) and therefore the particles thereof easily aggregate densely, while the anhydrous silica has a low density (i.e., 2 to 3 silanol groups/$nm^2$) and therefore the particles thereof become coarse flocculates which form a structure having high void volume.

The three-dimensional network structure is formed by linkage of secondary particles (aggregated fine silica fine particles) as described above. The secondary particles have generally a particle diameter of 10 to 100 nm, preferably 20 to 50 nm. The void volume of the colorant-receptive layer having the three-dimensional network structure is in the range of generally 50 to 80%, and the pores constituting the void have a mean diameter (mean pore diameter) of preferably 5 to 30 nm, especially 10 to 20 nm. The volume of the pores (pore volume) is in the range of preferably 0.5 to 0.9 ml/g, especially 0.6 to 0.9 ml/g. The BET specific surface area of the colorant-receptive layer is in the range of preferably 100 to 250 $m^2/g$, especially 120 to 200 $m^2/g$. The light transmittance of the colorant-receptive layer is preferably not lower than 70%.

In addition to the fine silica particles, the following materials may be used. For example, the materials (fine particles) having a refractive index of 1.4 to 1.60 can be mentioned. These materials do not generally lower the transmission of the sheet. Examples of such fine particles include colloidal silica, calcium silicate, zeolite, kaolinite, halloysite, muscovite, talc, calcium carbonate and calcium sulfate.

In the invention, for facilitating formation of the three-dimensional structure of the colorant-receptive layer (film), and for enhancing the film strength and for preventing cracks of the film when the film is dried, a water-soluble resin is used as a binder together with the silica fine particles. The ratio of the silica fine particles to the water-soluble resin (PB ratio; weight of the silica particles per 1 weight of the water-soluble resin binder) greatly influences the film structure. When the PB ratio is increased, the void volume, the volume of pores and the BET surface area (per unit weight) also are increased. If the PB ratio exceeds 10, the resin has no effects on the film strength and the prevention of the cracks in dry state. If the PB ratio is less than 1.5, the void is choked with the resin to lower the void volume, whereby the ink absorption properties are deteriorated. Therefore, the PB ratio preferably is in the range of 1.5 to 10. Especially, films having a lot of opportunities touched with hands, such as OHP films, need a sufficient film strength, and therefore the PB ratio is particularly preferably not more than 5. In order to obtain high-speed ink absorption in an ink-jet printer, the PB ratio particularly preferably is not less than 2. Accordingly, the PB ratio is more preferably in the range of 2 to 5.

For example, when a dispersion in which anhydrous silica particles having a mean primary particle diameter of not more than 10 nm have been highly dispersed in an aqueous solution containing a water-soluble resin in a PB ratio of 2 to 5 is coated on the support and dried, a three-dimensional network structure having secondary particles of silica particles as chain units is formed, whereby a porous film (colorant-receptive layer) having a mean pore diameter of not more than 30 nm, void volume of not less than 50%, a volume of pores of not less than 0.5 ml/g and a BET specific surface area of not less than 100 $m^2/g$ can be easily formed.

Examples of the water-soluble resins include resins having a hydroxyl group as a hydrophilic constituent unit such as polyvinyl alcohol (PVA), cellulose resins (e.g., methyl cellulose (MC), ethyl cellulose (EC), hydroxyethyl cellulose (HEC), carboxymethyl cellulose (CMC)), chitins and starch; resins having an ether linkage such as polyethylene oxide (PEO), polypropylene oxide (PPO), polyethylene glycol (PEG) and polyvinyl ether (PVE); and resins having an amide group or amide linkage such as polyacrylamide (PAAM) and polyvinyl pyrrolidone (PvP). Also employable are resins having a carboxyl group as dissociation group such as polyacrylic acid salts, maleic acid resins, alginic acid salts and gelatins; resins having sulfone group, such as polystyrenesulfonic acid salts; and resins having an amino group, imino group, tertiary amine or quaternary ammonium salt such as polyallylamine (PAA), polyethyleneimine (PEI), epoxidized polyamide (EPAm) and polyvinyl pyridine. From the viewpoint of light transmission, it is important which resin is used in combination with the silica fine particles. In the case of anhydrous silica, PVA, particularly PVA having a low saponification degree (preferably saponification degree of 70 to 90%) is preferred in view of light transmission properties. PVA has a hydroxyl group as its constituent unit, and it is thought that this hydroxyl group and the silanol group on the silica particle surface together form hydrogen bonding and therefore easily form a three-dimensional network structure having secondary particles of the silica particles as a chain unit, whereby a colorant-receptive layer having high void volume can be obtained.

In the ink-jet recording, the colorant-receptive layer obtained as above rapidly absorbs an ink by virtue of capillary action so as to make it possible to conduct precise recording free from occurrence of bleeding or blooming of ink or puddle of ink. In the thermal recording, a colorant can be firmly fixed to this layer, while in the electrophotographic recording, a toner can be firmly fixed to this layer. The reason is that the colorant or the toner enters into the pores of the porous layer, and as a result, the colorant or the toner is firmly fixed by the anchoring effect. Moreover, since the proportion of the silica particles to water-soluble resin is increased, the colorant-receptive layer shows high heat resistance and high resistance to embossing in the electrophotographic recording.

The colorant-receptive layer needs to have a thickness enough to absorb all of droplets of ink in the case of the ink-jet recording, and therefore the thickness should be determined in consideration of void volume of the film. For example, in the case where the ink quantity is 8 $nl/mm^2$ and the void volume is 60%, the colorant-receptive layer needs to have a thickness of not less than 15 μm. In the case of the ink-jet recording, the thickness preferably is in the range of 10 to 50 μm. In the case of the thermal transfer recording or the electrophotographic recording, the colorant-receptive layer may have a reduced thickness because a colorant or a toner is adsorbed on the surface, and the thickness thereof is preferably in the range of 0.1 to 10 μm.

Each of the fine silica particles and the water-soluble resin, both of which are major components of the colorant-receptive layer, may be used singly or in combination of plural kinds. Though the colorant-receptive layer are mainly composed of the fine silica particles and the water-soluble resin, the layer may contain, other than those materials, various kinds of inorganic salts to improve dispersibility of the particles, acids or alkalis as pH adjusters, and crosslinking agents to enhance strength of the layer. The colorant-receptive layer may further contain various surface active agents to enhance coating properties and surface smoothness. Moreover, the layer may contain surface active agents having ionic conductivity or metal oxide fine particles having electronic conductivity to inhibit electrification produced by friction or peeling on the surface or to adjust surface electrical resistance in the electrophotography. The colorant-receptive layer may also contain mordants to fix a dye and to enhance water resistance in the ink-jet recording. The layer may further contain various kinds of matting agents to reduce friction properties on the surface, or may contain various kinds of antioxidants and ultraviolet light absorbers to inhibit deterioration of a colorant.

An undercoat layer may be provided between the colorant-receptive layer and the transparent support to enhance adhesion or to adjust electrical resistance.

The colorant-receptive layer may be provided on one surface of the transparent support, or may be provided both surfaces to inhibit curling or the like.

For a film used as the transparent support, any materials can be used so far as they have such properties as resistant to radiant heat receiving when the recording sheet is used for OHP or back light displaying. Examples of such materials include polyesters such as polyethylene phthalate, cellulose esters such as nitrocellulose, cellulose acetate and cellulose acetate butyrate, polysulfone, polyphenylene oxide, polyimide, polycarbonate and polyamide. Preferred is polyethylene phthalate. Although there is no specific limitation on the thickness of the film, the thickness is preferably in the range of 50 to 200 μm in view of easy handling.

The support film may be beforehand subjected to a corona discharge treatment, a flame treatment and an ultra-violet-light irradiation treatment.

The colorant-receptive layer can be provided on the transparent support, for example, in the manner described as follows:

A coating solution for forming the colorant-receptive layer can be obtained below. Silica fine particles having a mean primary particle diameter of not more than 10 nm are added to water (e.g., content of silica: 10 to 15% by weight) and dispersed therein, for example, 10,000 rpm (preferably 5,000 to 20,000) for, for example, 20 minutes (preferably 10 to 30 minutes) using a high-speed rotary wet colloid mill (e.g., Creamix produced by M Technique Co., Ltd.). Then, an aqueous polyvinyl alcohol solution is added to the resulting dispersion (e.g., so that the weight of PVA is about ⅓ of the silica), and dispersed therein in the same manner as described above, followed by adjusting to pH 4.5. The coating solution thus obtained is a homogeneous sol, and this coating solution is coated on the transparent support by coating method to obtain a colorant-receptive layer having a three-dimensional network structure of the invention. In more detail, the coating solution of homogeneous sol is coated on the support and dried to evaporate water that is a solvent. When the coated layer reaches a gelation concentration through the evaporation, a wet gel is formed. As the drying further progresses, a porous xerogel is formed to obtain a colorant-receptive layer of the invention.

Otherwise, the colorant-receptive layer may be, for example, formed by coating a coating solution obtained by further adding an antistatic agent if desired on the above-mentioned transparent film and drying the coated layer under heating. The coating solution can be coated by any conventional means such as an air doctor coater, a blade coater, a rod coater, a knife coater, a squeeze coater, a reverse coater and a bar coater.

For preventing production of cracks of a colorant-receptive layer having a large thickness in dry state, the drying procedure is preferably carried out by initially drying at a relatively low temperature (preferably 50 to 90° C. (wind velocity: 3 to 8 m/sec)) for 0.5 to 3 minutes by means of a hot-air dryer and then drying at a relatively high temperature (preferably 120° to 180° C.) for 5 to 20 minutes.

After the coating procedure and the drying procedure are complete, the support having the coated layer may be passed through a roll nip under heating and applying a pressure using a super calendar, a gloss calendar, etc., whereby the resulting colorant-receptive layer can be improved in the surface smoothness, the transmission and the film strength. However, this treatment sometimes lowers void volume (i.e., the ink absorption properties are deteriorated), and therefore conditions hardly lowering void volume should be selected.

In the recording sheet of the invention, a solution comprising a silan coupling agent having a quaternary ammonium salt group is preferably coated on the colorant-receptive layer obtained above. The coated solution containing silan coupling agent is hardened by drying (preferably under heating). The provision of the obtained layer comprising silan coupling agent is generally performed in such a manner that the hardened silan coupling agent is mainly adsorbed to the pores of the colorant-receptive layer.

By the provision of the layer comprising silan coupling agent, a clear image in which occurrence of bleeding or blooming of ink or puddle of ink is extremely reduced can be obtained. In more detail, the silan coupling agent has a quaternary ammonium salt group and therefore the layer containing it strongly adsorbs ink and fixes it. Further, the layer has excellent water-resistance because the silan coupling agents are reacted with each other and reacted with hydroxy group of water-soluble resin, and therefore the adsorbed ink is not easily allowed to move even if water is stuck to the ink.

Examples of the silan coupling agent having a quaternary ammonium salt group are described below.

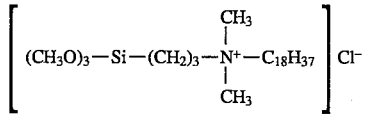

(1)

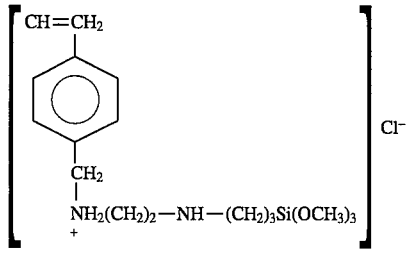

(2)

$$HOCH_2CH_2\overset{+}{N}(CH_3)_2C_3H_6Si(OCH_3)_3.Cl^-$$

(3)

The hardening of the above silan coupling agent is presumed to proceed as follows: Plural alkoxysilanyl groups are converted into silanol groups in the presence of moisture, and then the silanol groups are bonded each other by condensation reaction to form a cross-linked structure. The silan coupling agent is preferably contained in the colorant-receptive layer in the amount of 100 to 3600 mg/m$^2$ (more preferably 250 to 2200 mg/m$^2$).

The solution containing a silan coupling agent having a quaternary ammonium salt group is prepared by, for example, dissolving the silan coupling agent in an organic solvent (e.g., methanol, ethanol or isopropyl alcohol) or dispersing it in water, and adjusting to the concentration of 0.1 to 20 weight %.

The solution is coated on the colorant-receptive layer by any conventional means described above, and dried. The drying is generally conducted at a temperature of 50° to 180° C. for 0.5 to 60 minutes, and preferably at a temperature of 80° to 150° C. for 5 to 30 minutes.

In the invention, an anti-reflection layer may be provided on a surface of the side having no colorant-receptive layer of the transparent support to enhance light transmission. Further, the anti-reflection layer may be proided between the support and the colorant-receptive layer.

The anti-reflection layer is a layer of a refractive index of not more than 1.45, or a resin layer having a refractive index which satisfies both conditions of more than 1.45 and not more than a refractive index of the transparent support.

Examples of the layer of a refractive index of not more than 1.45 include a metallized layer of $CaF_2$, NaF, LiF, $MgF_2$ or $SiO_2$ which are formed by vacuum deposition or sputtering; a deposited layer of a fluoro resin such as polytetrafluoroethylene, polychlorotrifluoroethylene, polyvinyldene fluoride or ethylene/tetrafluoroethylene copolymer; and a coated layer of a fluoro resin such as polytrifluoroethylacrylate, polytrifluoropropylacrylate, polytrifluorobutylacrylate, polytrifluoroethylacrylate or polytrifluoroethylmethacrylate. The coated layer can be prepared by dissolving the fluoro resin such as polytrifluoroethylacrylate in an organic solvent and coating the solution on the support.

Further, the colorant receptive layer of the invention can be used as the anti-reflection layer because of its low refractive index.

Examples of materials of the resin layer having a refractive index (n) satisfying both conditions of more than 1.45 and not more than that of the transparent support (e.g., polyethylene terephthalate film: n=1.64) include acrylic resin (n: 1.48–1.52), polyester (n: 1.52–1.58), polyvinylidene chloride (n: 1.60–1.63), polyvinyl chloride (n: 1.54–1.55), polyvinyl acetate (n: 1.45–1.47), polystyrene (n: 1.59–1.60), polyamide (n: 1.53) and polyurethane (n: 1.50–1.60). The resin layer can be easily prepared by coating a solution of the resin in an organic solvent on the support and drying the solution layer. Preferred material of the resin are acrylic resin, polyester and polyvinylidene chloride from the viewpoint of adhesion to the support.

The thickness of the anti-reflection layer is preferably in the range of 0.01 to 10 μm, especially 0.05 to 5 μm.

The colorant-receptive layer of the invention can be provided on a support showing no high light transmittance, although the use of the support is outside the scope of the invention. Examples of such support include a support (e.g., paper, white plastic film) having polyolefin layer thereon, a support having polyolefin layer containing white pigment ( e. g., $TiO_2$) thereon, and a support having metallized layer of metal (e.g., Al thereon. In the case that the colorant-receptive layer is provided on the above support, the surface has a high reflection (generally not lower than 70%) so that an image formed on the surface shows high sharpness.

The present invention is further described by the following examples.

Example 1

(1) Composition of a coating solution for forming a colorant-receptive layer

| | |
|---|---|
| (i) Dry silica fine particles (mean primary particle diameter: 7 nm, refractive index: 1.45, number of silanol groups on surface: 2–3/nm$^2$, trade name: Aerosil A300 (available from Nippon Aerosil Co., Ltd.)) | 10 parts by weight |
| (ii) Polyvinyl alcohol (saponification degree: 88%, polymerization degree: 3,500, trade name: PVA23 (available from Kuraray Co., Ltd.)) | 3.3 parts by weight |
| (iii) Ion exchanged water | 136.0 parts by weight |

The silica fine particles (i) are introduced into a part of the ion exchanged water (iii) (73.3 parts by weight) and dispersed therein at 10,000 rpm for 20 minutes using a high-speed rotary wet colloid mill (Creamix, produced by M Technique Co. Ltd.). To the resulting dispersion was added an aqueous polyvinyl alcohol solution (solution obtained by dissolving polyvinyl alcohol in the remainder (62.7 parts by weight) of the ion exchanged water (iii)), and dispersing was carried out in the same manner as described above. Then, pH was adjusted to 4 to 5, to obtain a coating solution for forming a colorant-receptive layer.

(2) Coating and drying

A surface of a biaxially oriented polyethylene terephthalate film (n: 1.64) having a thickness of 100 μm was subjected to a corona discharge treatment. The coating solution obtained above was coated on the treated surface of the film with an air knife coater, and dried initially at 70° C. and wind velocity of 5 m/sec for 1 minute and then at 150° C. for 10 minutes by means of a hot-air dryer, to form a colorant-receptive layer having a dry thickness of 30 μm.

Thus, a recording sheet for ink-jet recording was obtained.

A scanning type electron photomicrograph (magnification of 100,000) of the surface and that of the section of the obtained colorant-receptive layer are shown in FIG. 2 and FIG. 3, respectively. As is evident from these photomicrographs, the colorant-receptive layer had a three-dimensional network structure.

Comparative Example 1

The procedures of Example 1 were repeated except that dry silica particles having a mean primary particle diameter of 30 nm (refractive index: 1.45, trade name: MOX-80 (available from Nippon Aerosil Co., Ltd.)) were used in place of the dry silica particles having a mean primary particle diameter of 7 nm, to prepare a recording sheet for ink-jet recording.

Comparative Example 2

The procedures of Example 1 were repeated except that alumina particles having a mean primary particle diameter of 13 nm (refractive index: 1.75, trade name: Aluminum Oxide C (available from Nippon Aerosil Co., Ltd.)) were used in place of the dry silica particles having a mean primary particle diameter of 7 nm, to prepare a recording sheet for ink-jet recording.

Comparative Example 3

The procedures of Example 1 were repeated except that the composition of the coating solution for forming a colorant-receptive layer was replaced with the following composition, to prepare a recording sheet for ink-jet recording.

| | |
|---|---|
| (i) Dry silica fine particles (mean primary particle diameter: 7 nm, refractive index: 1.45, number of silanol groups on surface: 2–3/nm$^2$, trade name: Aerosil A300 (Available from Nippon Aerosil Co., Ltd.,)) | 6.65 parts by weight |
| (ii) Polyvinyl alcohol (saponification degree: 88%, polymerization degree: 3,500, trade name: PVA235 (available from Kuraray Co., Ltd.)) | 6.65 parts by weight |
| (iii) Ion exchanged water | 86.7 parts by weight |

Example 2

The following solution containing a silan coupling agent was formed on the colorant-receptive layer of the recording sheet obtained in Example 1.

(2) Composition of a coating solution containing a

| | |
|---|---|
| (i) 3-(trimethoxysilyl)-propyldimethyl-octadecylammonium chloride (silan coupling agent (1) mentioned previously; trade name: Polon MF-50; available from Shin-etsu Chemical Industry Co., Ltd.) | 5 parts by weight |
| (ii) Methanol | 95 parts by weight |

The above coating solution is coated on the colorant-receptive layer using a bar coater of #3.1 in a coated amount of 1,100 mg/m$^2$ (solid amount), and then dried at 120° C. for 5 minutes, to prepare a recording sheet for ink-jet recording.

Example 3

The procedures of Example 2 were repeated except that N-β-(N-vinylbenzylaminoethyl)-γ-aminopropyltrimethoxysilan (silan coupling agent (2) mentioned previously; trade name: SZ6032 silan; available from Toray Silicone Co., Ltd.) was used in place of the 3-(trimethoxysilyl)propyldimethyloc-tadecylammonium chloride, and changing a coated amount from 1,100 mg/m$^2$ to 1,070 mg/m$^2$, to prepare a recording sheet for ink-jet recording.

Example 4

The procedures of Example 2 were repeated except that 3-(trimethoxysilyl)propyldimethylhydroxyethylammonium chloride (silan coupling agent (3) mentioned previously) was used in place of the 3-(trimethoxysilyl)propyldimethyloctadecylammonium chloride, and changing a coated amount from 1,100 mg/m$^2$ to 1,200 mg/m$^2$, to prepare a recording sheet for ink-jet recording.

The colorant-receptive layers obtained in Examples 2–4 were observed by a scanning type electron microscope (magnification of 100,000), and it was found that the colorant-receptive layers had a three-dimensional network structure.

Each of the recording sheets obtained above was evaluated on the physical properties in the following manner.

(1) Transmittance of parallel rays

The transmittance of parallel rays was measured using a haze meter (HGM-2DP, produced by Suga Testing Machine Co., Ltd.).

(2) Mean pore diameter, (3) Void volume, (4) Volume of pores, (5) Specific surface area These characteristics were examined using a mercury porosimeter (Poresizer 9320-PC2, produced by Shimazu Seisakusho, Ltd.) to obtain each distribution. From the distribution, a mean value was calculated.

(6) Secondary particle diameter of silica particles

The obtained colorant-receptive layer was observed by a scanning type electron microscope, and the secondary particle diameter was determined.

The results of the above evaluation are set forth in Table 1.

TABLE 1

| | Transmittance (%) | Pore Diameter (nm) | Void Volume (%(V/V) | Volume of Pores (ml/g) | Specific Surface Area (m$^2$/g) | Secondary Particle Diameter (nm) |
|---|---|---|---|---|---|---|
| Ex. 1 | 81.3 | 15 | 61 | 0.77 | 162 | 40 |
| Ex. 2 | 80.5 | — | — | — | — | — |
| Ex. 3 | 81.2 | — | — | — | — | — |
| Ex. 4 | 83.0 | — | — | — | — | — |
| Comp. Ex. 1 | 62.0 | 35 | 43 | 0.45 | 83 | 140 |
| Comp. Ex. 2 | 40.2 | 21 | 51 | 0.52 | 103 | 110 |
| Comp. Ex. 3 | 68.3 | 12 | 32 | 0.38 | 114 | 40 |

Each of the recording sheets for ink-jet recording obtained above was evaluated on the characteristics in the following manner.

(7) Ink absorption speed

Immediately after (about 10 seconds later) solid printing with red, yellow, blue and black inks was conducted on the recording sheet using an ink-jet printer (PIXEL JET, produced by Canon, Inc.), a sheet of paper is pressed onto the recording sheet. Whether the inks were transferred to the paper or not was observed, and the recording sheet was evaluated on the ink absorption speed based on the following classification.

AA: No ink was transferred to the paper.

CC: The inks were transferred to the paper.

(8) Bleeding of ink (color stain)

Using the same printer as described above, solid printing with red, yellow, blue and black inks was conducted on the recording sheet. The ink blotting at boundaries of the printed solid portions of those inks was observed, and the recording sheet was evaluated based on the following classification.

AA: No bleeding of ink was observed.

BB: A little bleeding of ink was observed.

CC: An amount of bleeding of ink was observed.

(9) Dot diameter

Using the same printer as described above, a dot was printed on the recording sheet with a black ink, and the diameter of the dot was measured by a microscope.

(10) Color density

Using the same printer as described above, solid printing with red, yellow, blue and black inks was conducted on the recording sheet. The color densities at the solid-printed portions of those inks were measured by an optical densitometer (X-Rite 310TR, produced by from X-Rite Co., Ltd.).

(11) Water resistance

Using the same printer as described above, the recording sheet on which black inks was printed, was dipped in water for 60 seconds. Then, the sheet was taken out, and the extent of spreading of ink was evaluated based on the following classification.

AA: No spreading of ink was observed.

BB: A little spreading of ink was observed.

CC: An amount of spreading of ink was observed.

The results of the above evaluation are set forth in Table 2.

TABLE 2

| | Ink Absorption Speed | Bleeding of Ink | Dot Diameter (μm) | Water Resistance | Color Density Yellow | Blue | Red | Black |
|---|---|---|---|---|---|---|---|---|
| Ex. 1 | AA | AA | 101 | — | 1.50 | 1.28 | 1.48 | 1.69 |
| Ex. 2 | AA | AA | 99 | AA | — | — | — | — |
| Ex. 3 | AA | AA | 101 | AA | — | — | — | — |
| Ex. 4 | AA | AA | 100 | AA | — | — | — | — |
| Comp. Ex. 1 | AA | AA | 108 | — | 1.42 | 1.21 | 1.40 | 1.66 |
| Comp. Ex. 2 | AA | AA | 107 | — | 1.46 | 1.26 | 1.41 | 1.67 |
| Comp. Ex. 3 | CC | BB | 122 | — | 1.38 | 1.11 | 1.40 | 1.59 |

Example 5

(1) Composition of a coating solution for forming a colorant-receptive layer

| | |
|---|---|
| (i) Dry silica fine particles (mean primary particle diameter: 7 nm, refractive index: 1.45, number of silanol groups on surface: 2–3/nm$^2$, trade name: Aerosil A300 (available from Nippon Aerosil Co., Ltd.)) | 1 part by weight |
| (ii) Polyvinyl alcohol (saponification degree: 88%, polymerization degree: 3,500, trade name: PVA235 (available from Kuraray Co., Ltd.)) | 0.33 part by weight |
| (iii) Ion exchanged water | 147.97 parts by weight |

The silica fine particles (i) are introduced into a part of the ion exchange water(iii) (82.3 parts by weight) and dispersed therein at 10,000 rpm for 20 minutes using a high-speed rotary wet colloid mill (Creamix, produced by M Technique Co., Ltd.). To the resulting dispersion was added an aqueous polyvinyl alcohol solution (solution obtained by dissolving polyvinyl alcohol in the remainder (65.67 parts by weight) of the ion exchange water), and dispersing was carried out in the same manner as described above. Then, pH was adjusted to 4–5, to obtain a coating solution for forming a colorant-receptive layer.

(2) Coating and drying

A surface of a biaxially oriented polyethylene terephthalate film having a thickness of 100 μm was subjected to a corona discharge treatment. The above-obtained coating solution was coated on thus treated surface of the film with a bar air knife coater of #12, and dried at 100 ° C. for 10 minutes by means of a hot-air dryer, to form a colorant-receptive layer having a dry thickness of 0.5 μm.

Thus, a recording sheet for electrophotography was obtained.

The obtained colorant-receptive layer was observed by a scanning type electron microscope (magnification of 100,000), and it was found that the colorant-receptive layer had a three-dimensional network structure.

Comparative Example 4

The procedures of Example 5 were repeated except that dry silica particles having a mean primary particle diameter of 30 nm (refractive index: 1.45, trade name: MOX-80 (available from Nippon Aerogel Co., Ltd.)) were used in place of the dry silica particles having a mean primary particle diameter of 7 nm, to prepare a recording sheet for electrophotography.

Comparative Example 5

The procedures of Example 5 were repeated except that alumina particles having a mean primary particle diameter of 13 nm (refractive index: 1.75, trade name: Aluminum Oxide C (available from Nippon Aerogel Co., Ltd.)) were used in place of the dry silica particles having a mean primary particle diameter of 7 nm, to prepare a recording sheet for electrophotography.

Each of the recording sheets for electrophotography obtained above was evaluated on the characteristics in the following manner.

(12) Toner adhesion

An image was formed on the recording sheet by an electrophotographic copying machine (VIVACE-120, produced by Fuji Xerox Co., Ltd.). With respect to the image-formed film thus obtained, the black solid portion was subjected to a cellophane tape peel test. The optical density of the toner image was measured by an optical densitometer (X-Rite 310TR, produced by X-Rite Co.) before and after the cellophane tape was peeled, and the film (recording sheet) was evaluated on the toner adhesion by the following equation.

$$\text{Toner adhesion} = \frac{\text{Optical density after peel of cellophane tape}}{\text{Optical density before peel of cellophane tape}} \times 100\ (\%)$$

(13) Resistance to embossing

An image was formed on the recording sheet by the same electrophotographic copying machine as described above. The image-formed film thus obtained was visually observed on the presence or absence of unevenness (protrusions and depressions; marked protrusions and depressions cause lowering of smoothness), and the film (recording sheet) was evaluated on the resistance to embossing based on the following classification.

AA: The copied film had no unevenness.

BB: The copied film had unevenness, and the smoothness of the film was lowered.

(14) Toner transfer density

An image was formed on the recording sheet by the same electrophotographic copying machine as described above, and the black solid portion of the image-formed film thus obtained was measured on the optical density by an optical densitometer (X-Rite 310TR, produced by X-Rite Co.).

Further, the physical characteristics (1) to (6) were also measured.

The results of the above evaluation ((1) to (6) and (12) to (14)) are set forth in Table 3.

TABLE 3

| | Void Volume (% (V/V) | Volume of pores (ml/g) | Specific Surface Area ($m^2/g$) | Secondary Particle Diameter (nm) |
|---|---|---|---|---|
| Ex. 5 | 60 | 0.77 | 162 | 40 |
| Comp. Ex. 4 | 43 | 0.45 | 83 | 140 |
| Comp. Ex. 5 | 51 | 0.52 | 103 | 110 |

| | Pore Diameter (nm) | Toner Adhesion (%) | Resistance to Embossing | Transfer Density | Transmittance (%) |
|---|---|---|---|---|---|
| Ex. 5 | 15 | 83 | AA | 1.14 | 87 |
| Comp. Ex. 4 | 35 | 69 | AA | 1.11 | 82 |
| Comp. Ex. 5 | 21 | 73 | AA | 1.12 | 87 |

We claim:

1. A recording sheet comprising a transparent support and a transparent colorant-receptive layer provided thereon, in which the colorant-receptive layer has a three-dimensional network structure having a void volume of 50 to 80%, the three-dimensional network structure being formed of silicic anhydride particles having a mean primary particle diameter of not more than 10 nm and a water-soluble resin wherein a weight ratio between the silicic anhydride particles and the water-soluble resin is in the range of 1.5:1 to 10:1.

2. The recording sheet as defined in claim 1, wherein the three-dimensional network structure has pores having a mean diameter of 5 to 30 nm.

3. The recording sheet as defined in claim 1, wherein the silicic anhydride particles have 2 to 3 silanol groups per 1 $nm^2$ on the particle surface.

4. The recording sheet as defined in claim 1, wherein the three-dimensional network structure is formed of linkage of secondary particles having a diameter of 10 to 100 nm which are aggregated products of the silica fine particles.

5. The recording sheet as defined in claim 1, wherein the water-soluble resin is polyvinyl alcohol.

6. A recording sheet comprising a transparent support and a transparent colorant-receptive layer provided thereon, in which the colorant-receptive layer has a three-dimensional network structure having a void volume of 50 to 80%, the three-dimensional network structure being formed of silica fine particles having a mean primary particle diameter of not more than 10 nm and a water-soluble resin wherein a weight ratio between the silica fine particles and the water-soluble resin is in the range of 1.5:1 to 10:1, and a layer comprising a silane coupling agent having a quaternary ammonium salt group is provided on the colorant-receptive layer.

* * * * *